US005664531A

United States Patent [19]

Kim

[11] Patent Number: 5,664,531

[45] Date of Patent: Sep. 9, 1997

[54] DEVICE FOR ADJUSTING VALVE DURATION USING EXTERNAL AIR SUPPLY

[75] Inventor: Kyu-Wan Kim, Kyung-Nam-Do, Rep. of Korea

[73] Assignee: Hyundai Motor Co., Ltd., Seoul, Rep. of Korea

[21] Appl. No.: 520,672

[22] Filed: Aug. 29, 1995

[30] Foreign Application Priority Data

Aug. 29, 1994 [KR] Rep. of Korea ..... 94-21364

[51] Int. Cl.[6] ..... F01L 3/10; F01L 13/00

[52] U.S. Cl. ..... 123/90.65; 123/90.67; 123/90.15

[58] Field of Search ..... 123/90.65, 90.66, 123/90.67, 90.15, 90.16

[56] References Cited

U.S. PATENT DOCUMENTS

| | | | |
|---|---|---|---|
| 3,094,976 | 6/1963 | May | 123/90.67 |
| 4,446,825 | 5/1984 | Giardini et al. | 123/90.65 |
| 4,559,909 | 12/1985 | Honda et al. | 123/90.67 |
| 4,777,916 | 10/1988 | Holmer | 123/90.67 |

FOREIGN PATENT DOCUMENTS

| | | | |
|---|---|---|---|
| 58-217711 | 12/1983 | Japan | 123/90.65 |
| 61-149510 | 7/1986 | Japan | 123/90.65 |
| 6-17611 | 1/1994 | Japan | 123/90.65 |

*Primary Examiner*—Weilun Lo

*Attorney, Agent, or Firm*—Birch, Stewart, Kolasch & Birch, LLP

[57] ABSTRACT

An improved device for adjusting a valve lift using external air supply, includes an operating chamber with a piston, and inner and outer valve spring seats with wax whereby in a low speed vehicle, when the engine oil has a high pressure, the heated air expands the wax and compresses a valve spring for adjusting the valve lift so as to effectively improve output power of the vehicle engine.

4 Claims, 3 Drawing Sheets

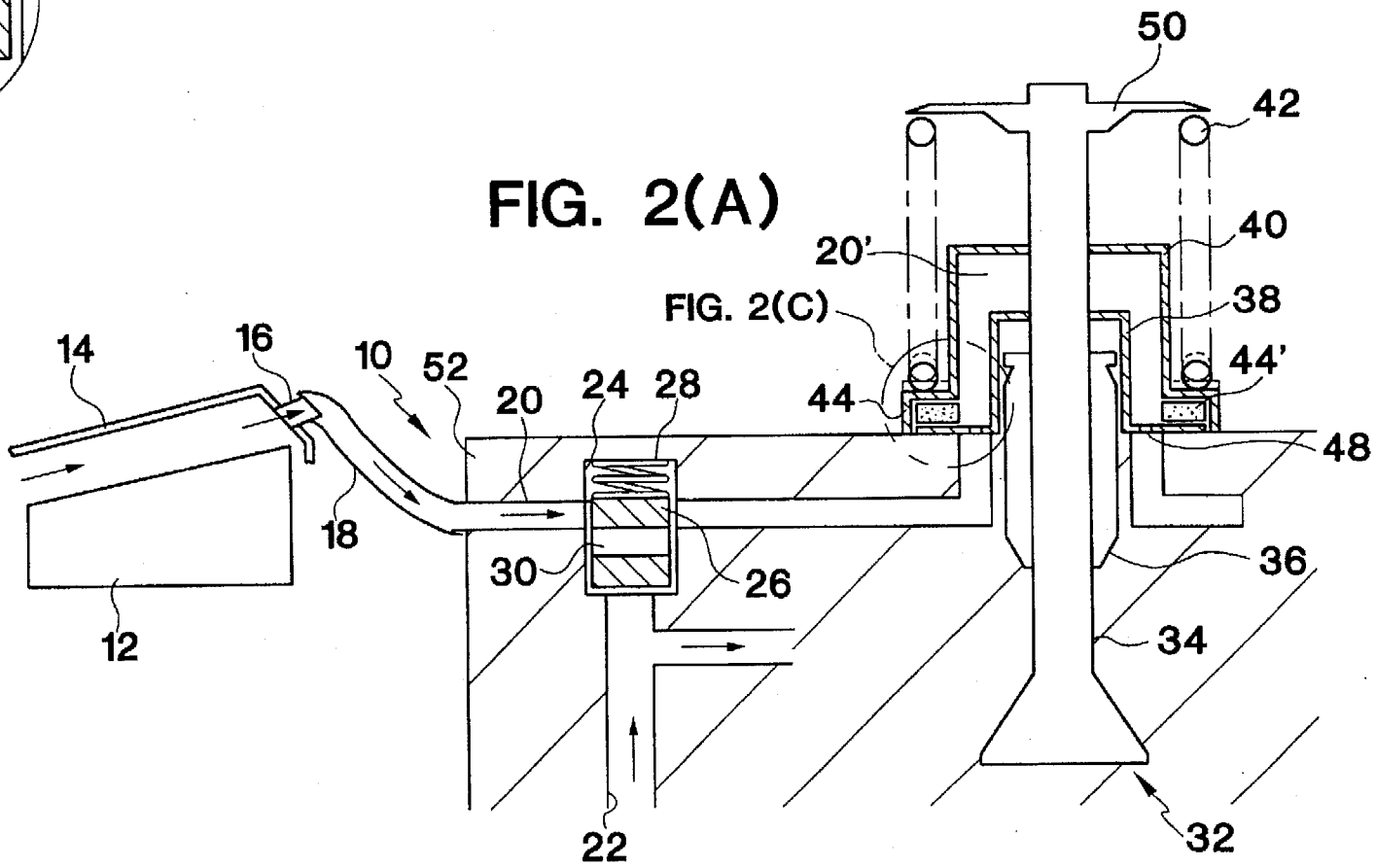
FIG. 2(A)
FIG. 2(C)
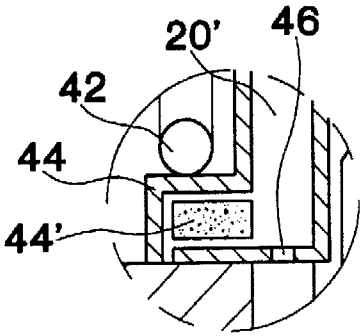

DEVICE FOR ADJUSTING VALVE DURATION USING EXTERNAL AIR SUPPLY

BACKGROUND OF THE INVENTION

1. Field of the Invention

The present invention relates to a device for adjusting valve duration using an external air supply and more particularly, to an improved device for adjusting valve duration using an external air supply, including an operating chamber with a piston, and inner and outer valve spring seats with wax whereby in a vehicle travelling at low speed, when engine oil has a high pressure, the heated air may expand the wax and compress a valve spring for adjusting the valve duration so as to effectively improve output power of the vehicle engine.

2. Description of Related Art

Various types of valve duration adjusting devices are known in the art. Generally, inlet and exhaust valves installed on a vehicle cylinder head function to induce air or mixed air into a vehicle cylinder, exhaust combusted gas, and prevent gas leakage by adhering to a valve seat in compression and explosion strokes.

Also the inlet and exhaust valves of the vehicle have to proceed with their respective functions. That is, while the vehicle piston operates in a circle, the inlet and exhaust valves have to accomplish intake and exhaust functions so as to improve efficiency of the cylinder. The inlet and exhaust valves are operated by a rocker arm which is operated by a cam which is rotated by a crank shaft through a timing belt.

Generally, there are two methods in the adjusting opening time of the inlet and exhaust valves. One of them is a valve timing adjusting method and the other is a valve duration adjusting method. That is, the valve timing adjusting method provides an adjusting method of a phase angle of the cam shaft, and the valve duration adjusting method provides a selective operating method of a pair of low and high rocker arms.

Usually, the vehicle engines are classified as a low output power engine in order to drive on a local road, and a high output power engine in order to drive on the highway. The low output power engine is a single over head cam shaft (SOHC) and the high output power engine is a double overhead cam shaft (DOHC). The SOHC engine is designed such that an amount of mixed air induced into the combustion chamber is at a maximum during opening to closing of the inlet valve in a low rpm, for example, 2,000–3,000 rpm. The DOHC engine is designed such that an amount of mixed air induced into the combustion chamber is at a maximum during opening to closing of the inlet valve in a high rpm, for example, 3,500–4,000 rpm.

However, if a vehicle designed as a low speed engine is driving in a high speed, the vehicle will suffer from a number of problems such as, for example, breaking power balance since all parts conflict mechanically and the intake manifold has resistance due to inertia of the piston and the valve train system, and reducing the intake efficiency since the mixed air induced into the combustion chamber flows backward to the intake manifold or the mixed air leaks to the outside through the exhaust manifold.

At this time, the actual amount of mixed air induced into the combustion chamber decreases when compared with the regular low speed state as shown in FIGS. 1(A) and 1(B). In FIG. 1(A), an amount of mixed air shown in a hashed line area is of an improper concentration, and in FIG. 1(B), an output power of the vehicle engine declines as shown in a solid line thereof.

SUMMARY OF THE INVENTION

Accordingly, it is an object of the present invention to provide a device for adjusting a valve duration using an external air supply, which eliminates the above problems encountered with conventional devices for adjusting a valve duration.

Another object of the present invention is to provide a valve duration adjusting device including an air passage and an operating chamber both disposed within a vehicle cylinder head, the operating chamber having a piston with a horizontal hole for operatively communicating with the air passage and the piston communicating with an engine oil, inner and outer valve spring seats having a pair of corner spaces for storing a wax insert, a valve of a valve stem passing through the inner and outer spring seats, and a valve spring disposed on the outer spring seat, whereby the engine oil has a high pressure in a high revolutions per minute of the vehicle engine and the horizontal hole communicates with the air ventilating passage by upward movement of the piston, the heated air expands the wax insert and the wax insert compresses the valve spring thereby shortening the length of the valve spring so as to adjust the valve duration and effectively improve output power of the vehicle engine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a device for adjusting a valve duration using external air supply, including an operating chamber with a piston, and inner and outer valve spring seats with a wax insert, whereby in a low speed vehicle, when the engine oil has a high pressure, the heated air expands the wax insert and compresses a valve spring for adjusting the valve lift duration so as to effectively improve output power of the vehicle engine.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein:

FIG. 2(A) is a sectional view of a device for adjusting a valve lift according to the present invention;

FIG. 2(C) is an enlarged view showing the corner spaces for storing a wax insert in association with the valve spring.

DETAILED DESCRIPTION OF THE PREFERRED EMBODIMENTS

Figure 2B:
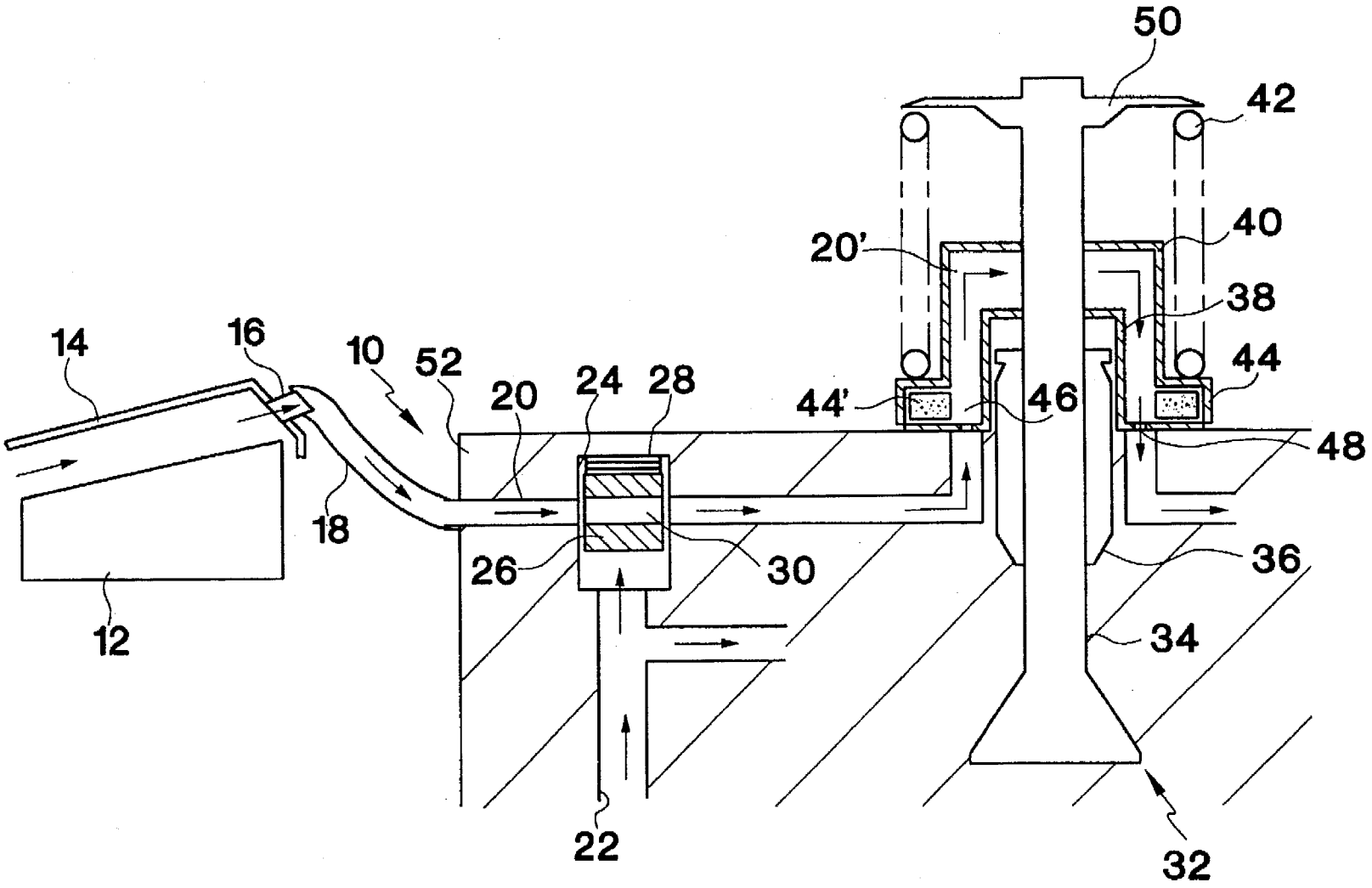
FIG. 2(B) is a sectional view of the device for adjusting a valve lift according to the present invention showing a valve spring of the device compressed by an outer valve spring seat depending upon expansion of wax in a corner space of the device according to the present invention.

Referring now in detail to the drawings for the purpose of illustrating preferred embodiments of the present invention, a device generally shown at 10 is provided for adjusting a valve duration using an external air supply as shown in FIGS. 2(A) and 2(B) which comprises a cylinder head 52 installed on a cylinder block (not shown).

The cylinder head 52 includes an oil circulating passage 22 disposed therein for dispersing oil through the oil circulating passage 22 and cooling the oil during circulation of the oil. Since the oil is supplied by an oil pump (not shown) which is operated by a crank shaft (not shown), oil pressure is changed by a number of revolutions per minute (rpm) of the vehicle engine, and the oil pressure is higher in a high rpm than in a low rpm of the vehicle engine.

The cylinder head 52 further includes an air ventilating passage 20 disposed therewithin and in the air ventilating passage 20, there is an operating chamber 24. The operating chamber 24 communicates with the oil circulating passage 22 and includes a piston 26 moveable up and down as shown in FIGS. 2(A) and 2(B), but more specifically, reciprocates in a direction perpendicular to a flow direction within the air ventilating passage 20. The piston 26 contains a horizontal hole 30 which communicates with the air ventilating passage 20 when the piston 26 moves up as shown in FIG. 2(B). A spring 28 is connected to the top of the piston at one end and at the other end thereof, to a ceiling of the operating chamber 24, so that the spring 26 normally biases the piston 26 in the downward direction.

A rubber hose 18 is connected to the air ventilating passage 20 at one end and a tubular port 16 of a heat protector 14 disposed on an exhaust manifold 12, at the other end thereof. Induced air stored in a space disposed between the exhaust manifold 12 and the heat protector 14 is heated and the heated air is supplied to the air ventilating passage through the rubber hose 18.

As shown in FIG. 2(A), when the oil which circulates through the oil circulating passage 22 has a low pressure, the piston 26 moves in the downward direction. Therefore, the heated air stops at the piston 26.

However, as shown in FIG. 2(B), when the oil has a high pressure during which the vehicle engine operates at a high number of revolutions per minute, the piston 26 moves up in the upward direction by pushing the piston 26 with the oil pressure. At that time, the air ventilating passage 20 is in communication with the horizontal hole 30. The heated air then combines through the ventilating passage 20 via the horizontal hole 30.

The cylinder head 52 further includes an inner valve spring seat 38 seated thereon, and an outer valve spring seat 40 seated thereon and surrounding the inner valve spring seat 38 for forming a space 20' which communicates with the air ventilating passage 20 and corner spaces 44 for storing a wax insert 44'. A valve 32 of a valve stem 34 pierces the inner and outer valve spring seats 38 and 40 and moves up and down.

A valve spring 42 for a valve 32 is seated on the outside of the outer valve spring seat 40 at the lower end, and the bottom of a retainer 50 fixed to the top of the valve stem 34. A valve stem guide 36 guides the up and down movement of the valve stem 34. The valve 32 is operated by a rocker arm (not shown) which is operated by a cam rotated by a crank shaft (not shown) through a timing belt (not shown).

The inner valve seat 38 includes an inlet 46 and an outlet 48 disposed in the bottom portions thereof for communicating with the air ventilating passage 20. As seen in FIG. 2(C), the wax insert 44' in the corner spaces 44 has an annular configuration, and contracts below about 80° C. and expands over about 90°–100° C.

The device for adjusting valve duration using an external air supply according to the present invention operates as follows. When the oil has a high pressure by operating the vehicle engine in a high rpm, the piston 26 moves up from the low position shown in FIG. 2(A) to the high position shown in FIG. 2(B). Accordingly, the heated air passes through the air ventilating passage 20 and passes through the horizontal hole 30 and the inlet 46, and finally reaches the wax insert 44'.

At this time, the wax insert 44' is expanded in response to the presence of heated air, and the outer spring seat 40 is moved up by the expansion of the wax insert 44' and compresses the valve spring 40. After the heated air expands the wax insert 44', the heated air passes through the outlet 48 and exhausts to an exterior of the device.

Accordingly, by maintaining the state of compression of the valve spring 42, when the valve 32 is opening, displacement of the valve spring 42, that is the distance which the valve spring can be compressed, is shortened. Therefore, the valve duration is adjustable.

Expressions of adjustment of the valve duration are shown as follows:

$$F=KX$$

wherein F is spring force, K is spring constant, and X is duration of the valve displacement;

If the displacement is 3, $$F_1=3K \quad (1)$$

wherein $F_1$ is spring force before the heated air is introduced into the air ventilation passage 20;

If the valve spring 42 is compressed by the expansion of the wax insert 44' by introduction of the heated air, the valve spring 42 is compressed as much as 1, $$F_2=K\ (X+1)$$

wherein $F_2$ is spring force after the heated air is induced into the air ventilating passage 20.

Figure 1A:
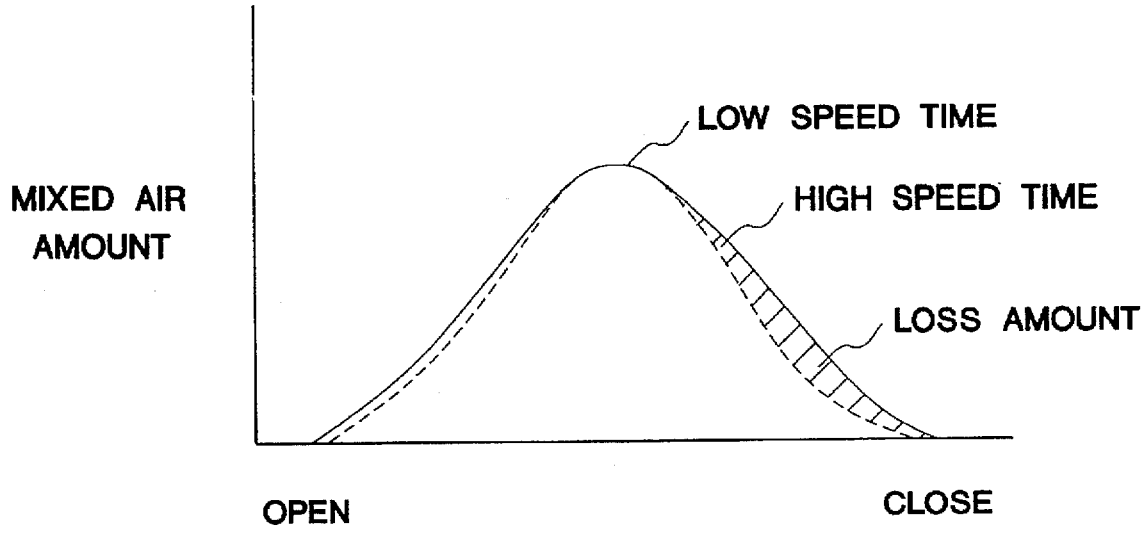
FIG. 1(A) is a graph showing a relationship of on/off states of a valve and an amount of mixed air when a vehicle engine operates at a low speed and at a high speed.
Figure 1B:
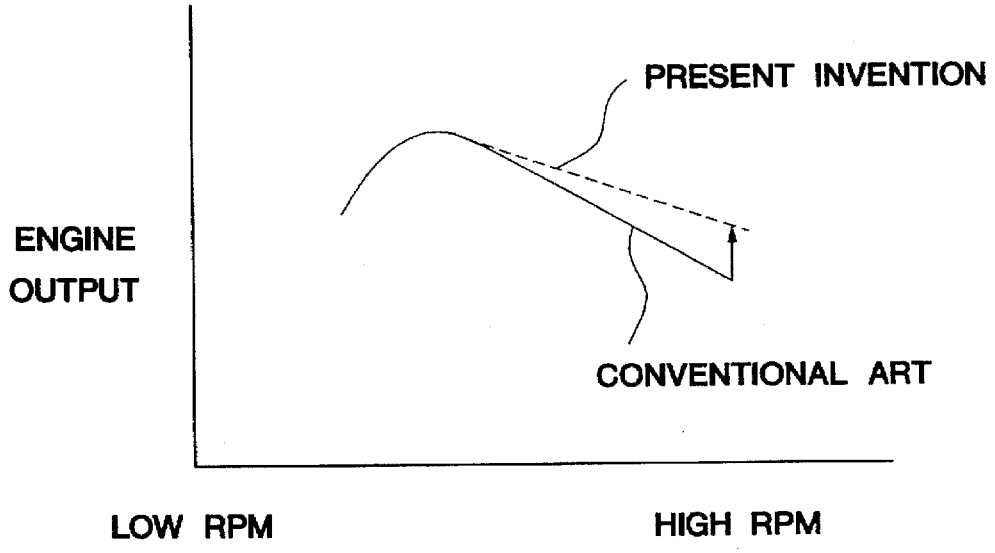
FIG. 1(B) is a graph showing a relationship of output power and an engine rpm.

By equaling force operated by the cam, the expression $F_1$ equals with the expression $F_2$. Therefore, X is 2. Accordingly, it is true that the valve duration changes to 2 from 3 by expansion of the wax insert 44'. As shown in a dotted line of FIG. 1(B), the output power of the vehicle engine by using the device 10 according to the present invention effectively improves compared with a conventional vehicle engine. It is believed that by using the device 10 according to the present invention, efficiency of the intake and exhaust air improves and output power of the vehicle engine also improves, since the valve duration effectively changes by using external air supply.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for adjusting engine valve duration using an external air supply, comprising:

an exhaust manifold;

a heat protector disposed over said exhaust manifold for forming a manifold space, said heat protector having a tubular port disposed at one side thereof; and a cylinder head disposed in the vicinity of said exhaust manifold, said cylinder head including:

an air ventilating passage for ventilating heated air generated from the manifold space, an operating chamber, operatively communicating with said air ventilating passage, and communicating with an oil circulating passage, said operating chamber containing a piston with a bore disposed perpendicular to an axial direction of piston displacement and a spring for biasing the piston, an inner spring seat seated thereon, an outer spring seat disposed over said inner spring seat for forming an air passage space communicating with the air ventilating passage and a pair of corner spaces for storing an annular wax insert, a valve having a movable valve stem passing through said inner and outer valve spring seats and fixed to a retainer, and a valve spring seated on an annular rim portion of said outer valve spring seat at the bottom thereof and attached to said retainer at the top thereof, such that when engine oil has high pressure at a high vehicle engine speed the bore of said piston communicates with the air ventilating passage by upward movement of the piston, the heated air expands the wax insert and the wax insert compresses the valve spring, so as to adjust the valve duration and effectively improve output power of the vehicle engine.

2. The device of claim 1, wherein said air ventilating passage is provided with a rubber hose connected to said tubular port of the heat protector for communicating with the manifold space.

3. The device of claim 1, wherein said inner valve spring seat includes an outlet disposed on the low portion thereof, respectively, for introducing and exhausting air from the air passage.

4. The device of claim 1, wherein said spring is connected to a top of said piston and a ceiling of said operating chamber for biasing the piston.

* * * * *